United States Patent [19]

Zausch et al.

[11] 4,235,330

[45] Nov. 25, 1980

[54] APPARATUS FOR TRANSPORTING PORTIONS OF OR ENTIRE SMOKERS' PRODUCTS

[75] Inventors: Wolfgang Zausch, Drage; Uwe Heitmann, Schwarzenbek, both of Fed. Rep. of Germany

[73] Assignee: Hauni-Werke Korber & Co. KG, Hamburg, Fed. Rep. of Germany

[21] Appl. No.: 57,972

[22] Filed: Jul. 16, 1979

[30] Foreign Application Priority Data

Jul. 29, 1978 [DE] Fed. Rep. of Germany ..... 2833346

[51] Int. Cl.[3] ..... B65G 29/00; B65G 47/91

[52] U.S. Cl. ..... 198/480; 198/495; 198/689

[58] Field of Search ..... 198/441, 450, 480, 481, 198/689, 803, 482, 494, 495

[56] References Cited

U.S. PATENT DOCUMENTS

| | | | |
|---|---|---|---|
| 2,171,193 | 8/1939 | Ruau | 198/689 X |
| 3,901,373 | 8/1975 | Rudzinat | 198/480 |

FOREIGN PATENT DOCUMENTS

| | | | |
|---|---|---|---|
| 1078229 | 8/1967 | United Kingdom | 198/480 |

*Primary Examiner*—James L. Rowland

*Attorney, Agent, or Firm*—Peter K. Kontler

[57] ABSTRACT

Apparatus for transporting filter rod sections or the like from a first to a spaced-apart second transfer station has a stationary hollow cylindrical core which is surrounded by a rotary drum-shaped conveyor having peripheral flutes and radially inwardly extending suction ports communicating with the flutes. The periphery of the core has an arcuate channel having a width in the range of a fraction of one millimeter and communicating with those ports which travel between the first and second transfer stations. The internal surface of the rotating conveyor constitutes the outer boundary of the channel and defines with the bottom surface of the core in the channel a plurality of flow restrictors each of which connects the inner end of a suction port in the region of the channel with a suction chamber in the interior of the core. This insures that particles of dust or the like cannot settle in the channel and also that suction in the chamber cannot collapse when the outer end or ends of one or more or all ports are free to communicate with the surrounding atmosphere. The core has an arcuate groove which is adjacent to one end of the channel, as considered in the axial direction of the core, and allows for at least substantially unrestricted flow of air from the channel into the chamber.

10 Claims, 3 Drawing Figures

APPARATUS FOR TRANSPORTING PORTIONS OF OR ENTIRE SMOKERS' PRODUCTS

BACKGROUND OF THE INVENTION

The present invention relates to apparatus for transporting discrete articles or commodities or groups of articles or commodities which form part of or constitute smokers' products. More particularly, the invention relates to improvements in apparatus for transporting rod-shaped, sheet-like or otherwise configurated articles which form part of or constitute smokers' products between a first transfer station to which the articles are delivered or fed by a first conveyor and a second transfer station at which the articles are accepted by a further conveyor. Still more particularly, the invention relates to improvements in apparatus wherein the articles are transported by a hollow rotary drum-shaped cylindrical conveyor and are attracted to the periphery of the drum-shaped conveyor by establishment of a pressure differential during transport from the first to the second transfer station. Articles which can be transported by the improved apparatus may constitute plain or filter tipped cigarettes, cheroots, cigars or cigarillos and/or one or more constituents of such smokers' products, e.g., filter rod sections, plain cigarettes, cigars or cigarillos, or adhesive-coated uniting bands which are used to connect filter plugs to tobacco-containing rod-shaped articles in a filter tipping machine. Furthermore, the articles may constitute component parts of packets for cigarettes or the like.

It is known to transport rod-shaped constituents of smokers' products in the peripheral flutes of a rotary drum-shaped conveyor wherein the flutes communicate with a suction chamber by way of suction ports which are machined into the shell or body of the conveyor. Such transport insures gentle treatment of articles and predictable delivery of articles to a further conveyor or the like at the second transfer station.

In a modern plant for the manufacture and/or processing of smokers' products, all or at least some machines are often connected to a common suction generating device. When the machines are arrested, e.g., at the end of a day's shift, it is customary to operate the machines until the last article or articles are removed from various conveyors or the like. If a machine includes one or more rotary drum-shaped conveyors of the type to which the present invention pertains, such conveyors or conveyors will be operated until all of the suction ports are exposed so that atmospheric air is free to enter the respective suction chamber by way of each and every suction port in the conveyor. When a machine embodying one or more suction-operated conveyors is to be started again, it is often difficult or impossible to immediately attract the articles to the periphery of the rotary conveyor or conveyors because the pressure differential is too low owing to the fact that all of the suction ports communicate with the atmosphere as well as with the suction chamber or chambers. As a rule, the suction generating device is dimensioned and adjusted in such a way that its capacity suffices to generate requisite suction under normal operating conditions, namely, when the majority of suction ports are sealed from the atmosphere by articles which are transported from the first to the second transfer station. Thus, such conventional transporting apparatus begin to operate satisfactorily only when a substantial number of suction ports between the two transfer stations are already overlapped by articles. This insures that the suction in ports between the two transfer stations suffices to adequately retain the articles on the rotating conveyor. It is neither practical nor economical to design the suction generating device in such a way that it can adequately attract a single article, a small number of articles or a maximum number of articles between the two transfer station. In addition to its higher cost, such suction generating device is undesirable or impractical because the filters which are integrated into the suction generating system between the suction ports and the suction generating device are normally designed to furnish a satisfactory filtering action only when the suction matches or closely approximates a predetermined value, namely, that pressure differential which prevails in normal operation when all or nearly all suction ports between the two transfer stations are overlapped by articles. The provision of auxiliary suction generating devices which are actuated when the machine embodying a transporting apparatus of the type to which the present invention pertains is to be set in motion is equally undesirable because the auxiliary devices contribute to initial and maintenance cost of the equipment. Moreover, it is normally necessary to provide the machine or machines with complex controls which automatically start one or more auxiliary suction generating devices when the pressure differential between the suction chamber or chambers and the surrounding atmosphere is too low.

British patent No. 1,078,229 discloses a transporting apparatus wherein a hollow cylindrical drum-shaped article-transporting conveyor surrounds and rotates with respect to a stationary core. The latter has a relatively narrow channel which extends between the two transfer stations and establishes direct communication between the inner ends of suction ports in the conveyor and a suction chamber in the core. The channel throttles the flow of air from the atmosphere into the suction chamber when one or more suction ports are not overlapped by articles. However, such narrow channel is often clogged by dust, fragments of tobacco or other foreign matter so that the maintenance cost of the patented apparatus is relatively high and the number and duration of down times is also high. Removal of foreign matter from the channel is a complex and time-consuming procedure.

Another transporting apparatus is disclosed in U.S. Pat. No. 3,901,373 granted Aug. 26, 1975 to Willy Rudszinat. This apparatus includes a stationary core which has an arcuate channel whose upstream and downstream ends communicate with the suction chamber. The channel is located radially inwardly of suction ports in the rotary cylindrical conveyor. Air which enters the channel via one or more suction ports must flow toward the one or the other end of the channel prior to admission into the suction chamber. It has been found that such apparatus cannot insure a satisfactory or reliable self-cleaning action because particles of dust, tobacco or the like are apt to remain in the channel in spite of the fact that the outer side of the channel is bounded by the moving internal surface of the cylindrical conveyor. During travel toward the one or the other end of the channel, particles of foreign matter are likely to accumulate in the channel and to form clots which exert an adverse influence upon suction in the ports of the rotating conveyor. Moreover, the pressure differential between the atmosphere and the suction chamber is too low to guarantee reliable retention of articles at the outer ends of suction ports which communicate with the channel of the core whenever a substantial number of ports between the two transfer stations are free to communicate with the atmosphere.

OBJECTS AND SUMMARY OF THE INVENTION

An object of the invention is to provide a transporting apparatus which can reliably attract and advance articles between two spaced-apart transfer stations irrespective of the number of articles which are disposed between such stations.

Another object of the invention is to provide the apparatus with novel and improved means for insuring that the pressure differential between the exposed ends of suction ports in the rotary drum-shaped conveyor and the suction chamber is satisfactory regardless of whether or not one, two, more than two or all suction ports between the two transfer stations are overlapped by articles.

A further object of the invention is to provide an apparatus which is constructed and assembled in such a way that the path for the flow of air between the suction ports and the suction chamber is very short and is not likely to be clogged by particles of dust or the like, and which is capable of performing a highly satisfactory and reliable self-cleaning action as soon as the rotary conveyor is set in motion.

An additional object of the invention is to provide a transporting apparatus which can be installed in cigarette making or other machines for the manufacture and/or processing of smokers' products as a simpler and more reliable substitute for existing transporting apparatus.

Another object of the invention is to provide the apparatus with a novel and improved stationary core for the rotary drum-shaped article-transporting conveyor.

The invention resides in the provision of an apparatus for transporting articles (e.g., filter rod sections, plain or filter tipped cigarettes, cigars or cigarillos, groups of such rod-shaped articles and/or portions of webs of wrapping or like material) which constitute or form part of smokers' products from a first to a spaced-apart second transfer station. The apparatus comprises a core having a suction chamber (the core may constitute a fixedly mounted stationary hollow cylindrical body whose axial bore constitutes the suction chamber), at least one shallow arcuate peripheral channel which communicates with the suction chamber substantially along its full length, as considered in the circumferential direction of the core, and extends between the two transfer stations, and a bottom surface in the channel. The apparatus further comprises a hollow rotary cylindrical conveyor having a cylindrical internal surface surrounding the periphery of the core and being spaced apart from the bottom surface in the channel of the core, and an annulus of suction ports extending inwardly from the periphery of the conveyor and communicating with the channel during travel of such ports between the two transfer stations so as to attract articles which are fed to the periphery of the conveyor at the first station. The surfaces which are disposed radially inwardly and outwardly of the channel define a plurality of flow restricting path for air which flows into the channel via ports which are not overlapped by articles.

In accordance with a presently preferred embodiment of the improved apparatus, the core has an arcuate groove which establishes practically unrestricted communication between one end of the entire arcuate channel (as considered in the axial direction of the core and conveyor) and the suction chamber. This insures that the surfaces which are located radially inwardly and outwardly of the channel define the aforementioned parallel-connected flow restrictors between the suction ports which communicate with the channel and the groove in the core. Consequently, the peripheral surface of the conveyor can adequately attract and retain a single article or a small number of articles because the ports which are not overlapped by articles communicate with the groove by way of discrete flow restrictors.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
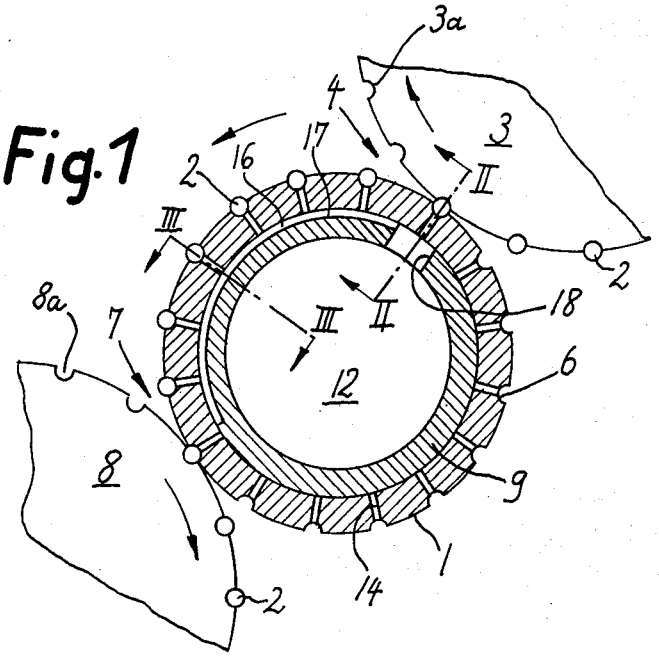
FIG. 1 is a fragmentary partly end elevational and partly transverse sectional view of an apparatus which embodies the invention, the section being taken in the direction of arrows as seen from the line I—I of FIG. 2.
Figure 2:
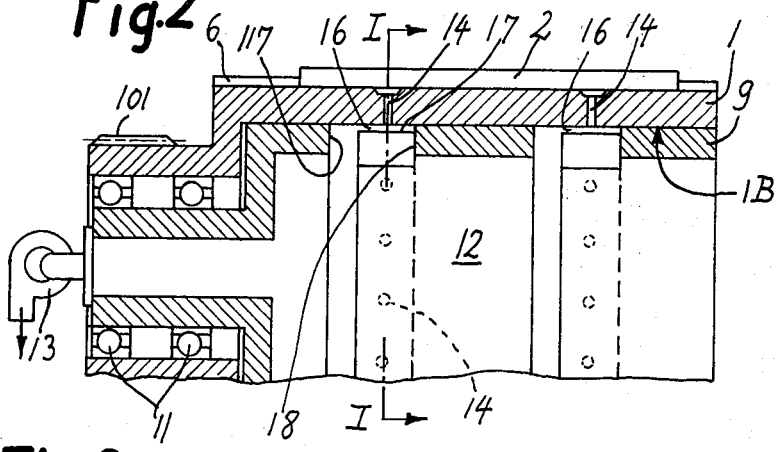
FIG. 2 is an enlarged fragmentary axial sectional view as seen in the direction of arrows from the line II—II of FIG. 1.
Figure 3:
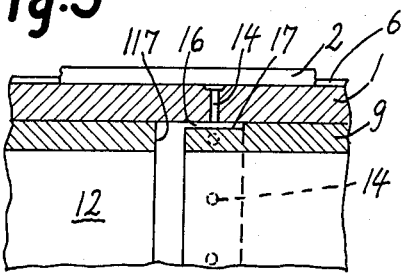
FIG. 3 is an enlarged fragmentary axial sectional view as seen in the direction of arrows from the line III—III of FIG. 1.

The apparatus which is shown in FIGS. 1 to 3 comprises a hollow drum-shaped cylindrical conveyor 1 which serves to transfer filter rod sections 2 or other rod-shaped or otherwise configurated articles or commodities between a first transfer station 4 and a second transfer station 7. The conveyor 1 can be used with equal advantage for transport of a succession of other types of rod-shaped or flat articles, such as plain or filter tipped cigarettes, components of filter tipped cigarettes, uniting bands which are utilized to connect filter plugs with plain cigarettes in a filter tipping machine and/or many others. It will be noted that, in addition to a mere conveying or transporting function, the conveyor 1 can also serve to cooperate with one or more other components in order to treat the articles which are transported between the transfer stations 4 and 7. One of such treatments includes the aforementioned application of uniting bands to filter plugs which are adjacent to discrete plain cigarettes or are located between pairs of coaxial plain cigarettes in a filter tipping machine. A suitable filter tipping machine is manufactured by the assignee of the present application and is known as MAX S. In such machine, the conveyor 1 can be used to transport adhesive-coated uniting bands to a transfer conveyor which is formed with flutes for groups of coaxial rod-shaped articles (each such group normally includes two spaced-apart coaxial plain cigarettes of unit length and a filter plug of double unit length therebetween). It is also possible to employ two or more conveyors 1 in a single machine, especially in a machine for the manufacture and/or processing of smokers' products.

If the conveyor 1 is used for the transport of adhesive-coated uniting bands, it is contacted by and attracts the leader of a web of uniting band material and cooperates with a rotary knife which severs the leader at regular intervals so that the web yields a succession of discrete uniting bands. Since the illustrated conveyor 1 serves to transport filter plugs 2 or other rod-shaped articles, its peripheral surface is formed with a plurality of equally spaced axially parallel article-receiving flutes 6 each of which receives a filter plug 2 at the first transfer station 4 and each of which delivers the thus received filter plug 2 to the oncoming flute 8*a* of a rotary drum-shaped article-accepting conveyor 8. The means for feeding filter plugs 2 to successive flutes 6 at the transfer station 4 comprises a further rotary drum-shaped conveyor 3 which is formed with axially parallel peripheral flutes 3*a*. The means for driving the conveyors 1, 3 and 8 in synchronism is not specifically shown in the drawing. FIG. 2 merely shows a gear 101 which drives the conveyor 1. This gear preferably forms part of a gear train including additional gears which transmit torque to the conveyors 3, 8. At least one gear of the gear train receives torque from a suitable main prime mover of the machine which embodies the improved apparatus, e.g., from a variable-speed motor of a filter tipping machine. A filter tipping machine wherein the apparatus of the present invention can be put to use is disclosed, for example, in commonly owned U.S. Pat. No. 4,154,090 granted May 15, 1979 to Uwe Heitmann et al.

The conveyor 1 is a hollow drum which rotates on a stationary core in the form of a composite hollow cylindrical valve member 9. The conveyor 1 rotates on antifriction bearings 11 which surround the left-hand end portion of the core 9, as viewed in FIG. 2. The interior (axial bore) of the core 9 constitutes a relatively large suction chamber 12 which is connected with the intake of a suction generating device 13, e.g., a suitable fan. The rate at which the fan 13 draws air from the suction chamber 12 is preferably constant.

Each flute 6 of the conveyor 1 communicates with the outer ends of two radially inwardly extending suction ports or openings 14 which serve to attract the articles 2 to the periphery of the conveyor 1 during transport from the station 4 to the station 7. The means for establishing communication between the inner ends of the suction ports 14 and the suction chamber 12 during travel of such ports from the station 4 toward the station 7 comprises two relatively narrow semicircular channels 16 which are machined into the periphery of the stationary core. Each of these channels is in register with a set or annulus of suction ports 14 (see FIGS. 2 and 3), and each channel is bounded by a bottom surface 17 in the periphery of the core 9 as well as by the cylindrical internal surface 1B of the rotary conveyor 1. Each channel 16 extends from the first transfer station 4 to the second transfer station 7 and the width of these channels, as considered in the radial direction of the conveyor 1, is greated exaggerated in the drawing for the sake of clarity. In actual practice of the invention, the width of such channels is in the range of one or more tenths of one millimeter. The ports 14 are machined into those portions of the conveyor 1 which surround the respective bottom surfaces 17.

The width of the channels 16, as considered in the axial direction of the conveyor 1, exceeds the diameters of the suction ports 14 (see FIGS. 2 and 3) and is several times the first-mentioned width of the channels (as measured in the radial direction of the conveyor 1).

Each channel 16 communicates with the suction chamber 12 by way of a relatively wide arcuate groove 117 which is machined into the core 9 adjacent to the left-hand axial end of the respective channel, as viewed in FIG. 2. Thus, when the fan 13 is on, it draws air from those suction ports 14 which travel from the station 4 toward the station 7 whereby the air streams flow radially inwardly (via ports 14), thereupon axially of the core 9 (in the channels 16) and finally radially inwardly toward and into the chamber 12 (via grooves 117). The length of the grooves 117, as considered in the circumferential direction of the core 9, equals or approximates the corresponding length of the associated channels 16. The grooves 117 are arcuate cutouts in the material of the core 9. It will be noted that, while flowing from a channel 16 into the associated groove 117, an air stream must change the direction of its flow by approximately 90 degrees and flows along a narrow edge face of the core. The surfaces bounding the channels 16 constitute flow restrictors which throttle the flow of air from the inner ends of the ports 14 into the associated grooves 117 and thence into the suction chamber 12. This insures that, even if all of the flutes 6 are unoccupied, (i.e., even if the conveyor 1 does not carry any articles 2 from the station 4 toward the station 7), suction in the chamber 12 cannot collapse as a result of inflow of excessive amounts of air via ports 14. In fact, by appropriate selection of the width of the channels 16, one can insure highly predictable attraction of articles 2 to the surfaces bounding the respective flutes 6 regardless of the number of articles on the conveyor 1 between the stations 4 and 7. In other words, the force with which the articles 2 are attracted on their way from the station 4 to the station 7 can be selected in advance independently or substantially independently of the number of occupied or unoccupied flutes 6 between the one and the seven o'clock positions, as viewed in FIG. 1. When the conveyor 1 does not carry any articles 2, suction in each port 14 which travels from the station 4 to the station 7 suffices to attract and retain an article which is delivered at the station 4. The surfaces which are inwardly and outwardly adjacent to the channels 16 (as considered in the radial direction of the conveyor 1) define throttling orifices to restrict the flow of air along the shortest paths from the ports 14 into the chamber 12. Therefore, suction in those ports 14 which are overlapped by the wrappers of articles 2 in the respective flutes 6 suffices to attract such articles to the conveyor 1 even if the number of articles travelling from the station 4 to the station 7 is only a small fraction of the total number of flutes between the stations 4 and 7.

Another important advantage of the improved apparatus is that particles of dust, tobacco and/or other foreign matter cannot settle in and cannot clog the channels 16. This is due to the fact that the internal surface 1B of the conveyor 1 moves with respect to the bottom surfaces 17 of the channels 16. Consequently, any particles which happen to penetrate into the channels 16 are agitated and entrained by inflowing air into the relatively large suction chamber 12 anywhere along the full length of the channels, as considered in the circumferential direction of the core 9. Such self-cleaning action insures that suction in each of the ports 14 which register with the one or the other channel 16 is always within the optimum range.

In order to promote the transfer of articles 2 from the oncoming flutes 3*a* into the oncoming flutes 6 at the station 4, the core 9 has a relatively large bore or aperture 18 at the upstream end of each channel 16 to thus insure that the flow-restricting action inwardly of the transfer station 4 is nil or only a small fraction of the flow restricting action upon air streams which flow from the inner ends of the ports 14 and into the chamber 12 via the respective channels 16. The cross-sectional area of each aperture 18 is preferably a large multiple of the cross-sectional area of a port 14.

The suction ports which are machined into the accepting conveyor 8 to attract the articles 2 which reach the transfer station 7 are not shown in the drawing. Such ports enable the conveyor 8 to attract each article 2 which reaches the downstream ends of the channels 16. If desired, the ports in the conveyor 8 and/or the ports in the feeding conveyor 3 can be replaced with shrouds or other mechanical retaining means for articles 2 which advance toward the station 4 and/or which advance beyond the station 7.

The provision of several channels 16 and several annuli of ports 14 is desirable if the articles are relatively large or long.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for transporting articles which constitute or form part of smokers' products from a first to a second transfer station, comprising a core having a suction chamber, at least one shallow arcuate peripheral channel communicating with said chamber substantially along the full length of said channel, as considered in the circumferential direction of said core, and extending between said stations, and a bottom surface in said channel; and a hollow rotary cylindrical conveyor having a cylindrical internal surface surrounding the periphery of said core and being slightly spaced apart from said bottom surface, and an annulus of suction ports extending inwardly from the periphery of said conveyor and communicating with said channel during travel between said stations so as to attract articles which are fed to the periphery of said conveyor at said first station, said surfaces defining a plurality of flow restricting paths for air entering said channel via ports which are not overlapped by articles and flowing toward and into said chamber.

2. The apparatus of claim 1, wherein said core comprises a hollow stationary cylinder and said suction chamber is surrounded by said cylinder.

3. The apparatus of claim 1, wherein said core has an arcuate groove which establishes substantially unrestricted communication between said channel and said suction chamber.

4. The apparatus of claim 3, wherein said groove is adjacent to one end of said channel, as considered in the axial direction of said conveyor.

5. The apparatus of claim 1, wherein said channel has an upstream end at said first station, as considered in the direction of rotation of said conveyor, and said core has an aperture communicatively connecting said upstream end with said chamber, said aperture being in register with successive ports arriving at said first station.

6. The apparatus of claim 5, wherein the cross-sectional area of said aperture exceeds the cross-sectional area of a port in said conveyor.

7. The apparatus of claim 1, wherein said core has a second channel communicating with said chamber and being spaced apart from said first mentioned channel, as considered in the axial direction of said conveyor, and said conveyor has a second annulus of suction ports communicating with said second channel during travel from said first to said second station.

8. The apparatus of claim 1, wherein said conveyor has peripheral flutes and said ports have outer ends, as considered in the radial direction of said conveyor, the outer end of each of said ports communicating with a different flute.

9. The apparatus of claim 1, wherein the distance between said surfaces, as considered in the radial direction of said conveyor, is less than one millimeter.

10. The apparatus of claim 1, further comprising a second conveyor for feeding articles to said first station and a third conveyor for accepting articles at said second station.

* * * * *